US005669817A

United States Patent [19]

Tarantino

[11] Patent Number: 5,669,817

[45] Date of Patent: Sep. 23, 1997

[54] CASINO CARD TABLE WITH VIDEO DISPLAY

[76] Inventor: Elia R. Tarantino, 2251 Fort Apache Rd., Las Vegas, Nev. 89117

[21] Appl. No.: 591,842

[22] Filed: Jan. 25, 1996

[51] Int. Cl.[6] ..... A47B 25/00; A63F 1/00; A63F 9/22

[52] U.S. Cl. ..... 463/13; 463/31; 463/46; 273/309

[58] Field of Search ..... 273/138 A, 143 R, 273/138.2, 309; 463/12, 13, 20, 22, 25, 26, 27, 28, 29, 32, 33, 34, 46

[56] References Cited

U.S. PATENT DOCUMENTS 4,614,342 9/1986 Takashima ..... 463/46
4,760,527 7/1988 Sidley ..... 364/412
4,995,615 2/1991 Cheng ..... 273/292
5,221,083 6/1993 Dote ..... 463/32

*Primary Examiner*—Benjamin H. Layno
*Attorney, Agent, or Firm*—Townsend and Townsend and Crew

[57] ABSTRACT

A casino game table for card games such as poker includes a plurality of displays that operate to display dealt card representations in lieu of actual dealt cards. The game table includes a dealer position and a number of player positions. Each player position has a video display upon which is displayed, during game play, representations of game cards viewable substantially only by the associated player. The dealer position has a video display viewable by players and the dealer, upon which are displayed representations of cards dealt the dealer during game play, and cards of the dealer and participating players at the conclusion of game play. The dealer position includes game controls for initiating and maintaining game play.

21 Claims, 4 Drawing Sheets

CASINO CARD TABLE WITH VIDEO DISPLAY

BACKGROUND OF THE INVENTION

This invention is directed generally to casino games, and in particular to a game table for playing a casino game such as poker without physical cards, using a processing system-controlled displays that provide card representations for game play.

A measure of profits sometimes used by casinos is the number of games dealt per hour by a dealer. This can vary, depending upon a number of variables, including the type of game being played, the number of players, and the like. Many casino table games, such as poker, produce revenue for the casino by a percentage of each game's pot (cumulative wagers of the players during any round of game play). Thus, it is beneficial to have a large number of players. Even so, play time increases with the count of player participation.

The game can also be affected by cheating. A new deck of cards can be marked so that an unscrupulous and cunning player can shift the odds away from the other participants during game play. To minimize card-marking, a deck of cards is short-lived. A deck will perhaps see several shuffles before being tossed for a new deck. Even though there is an after-market for used decks of cards, new card purchase is a large and expensive burden of doing casino business.

But cheating is not limited to card marking; there are other ways to bend the odds of the game in favor of a particular player, including suborning the dealer (termed "cross-roading" in the art). If the dealer is sufficiently proficient, he/she can shuffle and stack a deck of cards for any eventual delivery. This form of cheating cannot be obviated by a change of cards.

There are, of course, available today electronic video poker games structured to present on a video display screen card representations for the play of a hand of poker. However, the player does not pit him/herself against another human player, although some machines pit the player against itself (which is usually under control of some computing apparatus, such as a microprocessor, or a special purpose processing system). Most video poker games are constructed so that to win the player tries to obtain the highest ranking poker hand possible: the higher the hand, the higher the payout. An example of such a video poker game can be found in U.S. Pat. No. 5,356,140.

Among the problems found by users of video poker games is that the camaraderie found and enjoyed by many in a communal game is missing. Also lacking is the competitive feeling of pitting oneself against the skill and luck of others.

SUMMARY OF THE INVENTION

The present invention relates generally to casino games, and particularly to a casino card table having video displays for displaying card representations dealt to players and a dealer. Broadly, the invention comprises a casino table having a dealer position, and a number of player positions. Each player position is equipped with a small, private video display unit positioned and constructed so that it can be viewed only by the player at the corresponding player position. In this vein, each player's video display unit includes a sliding shutter or shield that is biased to a position to cover and conceal from others attempting to view the cards displayed on the player's video display. The dealer position includes a large screen video display that is viewable by all at the game table. The video display units display card representations in response to control signalling from a control processor system actuated by a dealer. Actions of the control processor system are guided by depressible buttons at the player and dealer positions that are depressed as game play is initiated and continued.

The game table of the present invention is constructed to implement the game play of the traditional "Texas Hold 'Em" poker game, in which participating players are dealt two cards, and the dealer ultimately takes five cards. The player able to assemble the best five-card poker hand from the two player cards, and three of the five of the dealer wins. However, rather than using real cards, the invention provides the same game play with game simulation created by the control processor system to provide card representations displayed on screens of the player position of participating players and the dealer position video display units. At the conclusion of the game, card representations of those players remaining in the game (i.e., those that have not folded during game play) are displayed along with those of the dealer on the screen of the video display unit of the dealer position for viewing by all. The players can then view who has the winning five-card combination and the dealer announces the winner.

A number of advantages should now be apparent. Without the need for physical cards, the cost of card purchases is eliminated, as is the capability of cheating by marking the cards. The potential for suborning the dealer is also erased.

These and other advantages will become apparent to those skilled in this art upon a reading of the following detailed description of the invention, which should be taken in conjunction with the accompanying drawings.

DESCRIPTION OF THE PREFERRED EMBODIMENT

Figure 1:
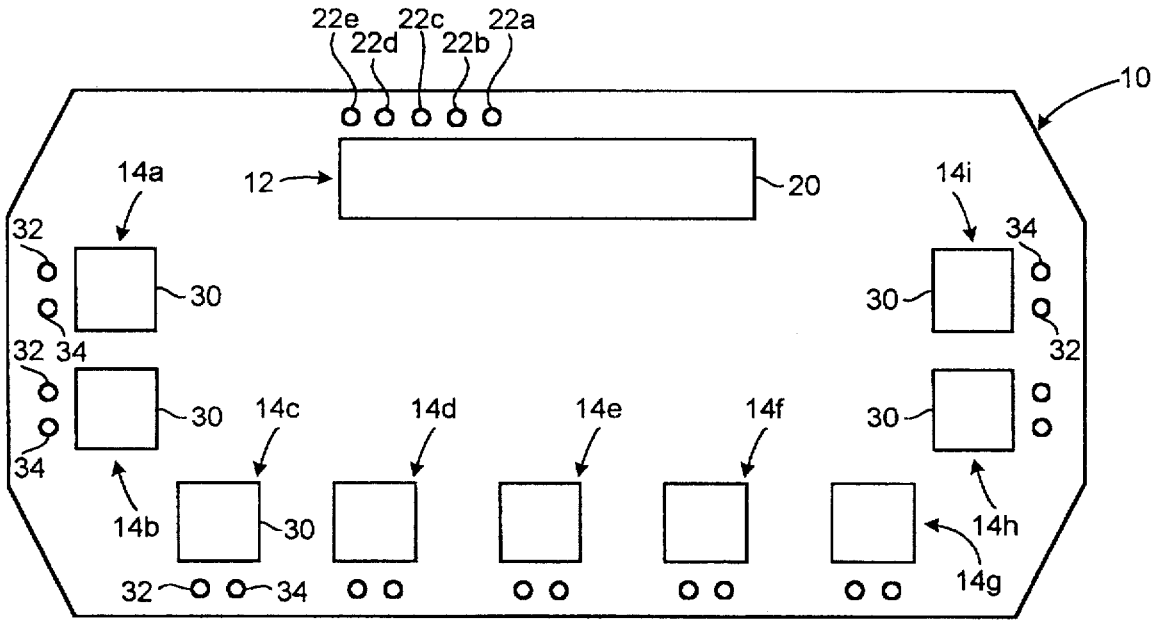
FIG. 1 illustrates game table structured according to the present invention, showing a the dealer position and a number of player positions.

Turning now to FIG. 1, there is illustrated a casino game table 10 constructed according to the teachings of the present invention. As FIG. 1 shows, the game table 10 includes a dealer's station 12 and a number of player stations 14 (14*a*, 14*b*, . . . 14*i*). The dealer's station 12 is depicted as including a video display unit 20 and a number of finger depressible, game control buttons 22 (22*a*, 22*b*, . . . , 22*e*). The video display unit 20 at the dealer's station 12 is viewable by all at the table 10: the dealer and all players.

Each player station is similarly provided with a smaller video display unit 30 and game play buttons 32, 34. The video display units 30 at each of the player stations 14*a*, 14*b*, . . . , 14*i* are preferably viewable only by those located at the associated player station, i.e., the player. As will be seen, a sliding shield 40 (FIGS. 2 and 3) is provided each video display unit 30 to cover the display screen 30' upon which card representations are displayed (FIG. 2), in much the same way a player's hand of cards is covered by the player when using playing a traditional card game.

The two game play buttons 32, 34 at each player station 14 are finger-depressible. Preferably, the buttons 32, 34 will illuminate when depressed. Button 32 can be green in color, and button 34 red, so that when illuminated the colors predominate and can be seen by, for example, from the dealer and any player position. Game play button 32, when depressed, operates to signal a player's intention to participate in a round of play; game play button 34 operates to signal a player's decision to drop out of game play, removing the display of card representations from the player's display unit 30, and locking the sliding shield 40 in a closed position covering and concealing the display screen 30' from view. Accordingly, if desired, the buttons 32, 34 can be labelled to explicitly explain their function such as with the terms "ANTE" and "FOLD," respectively, or with like terms.

Figure 2:
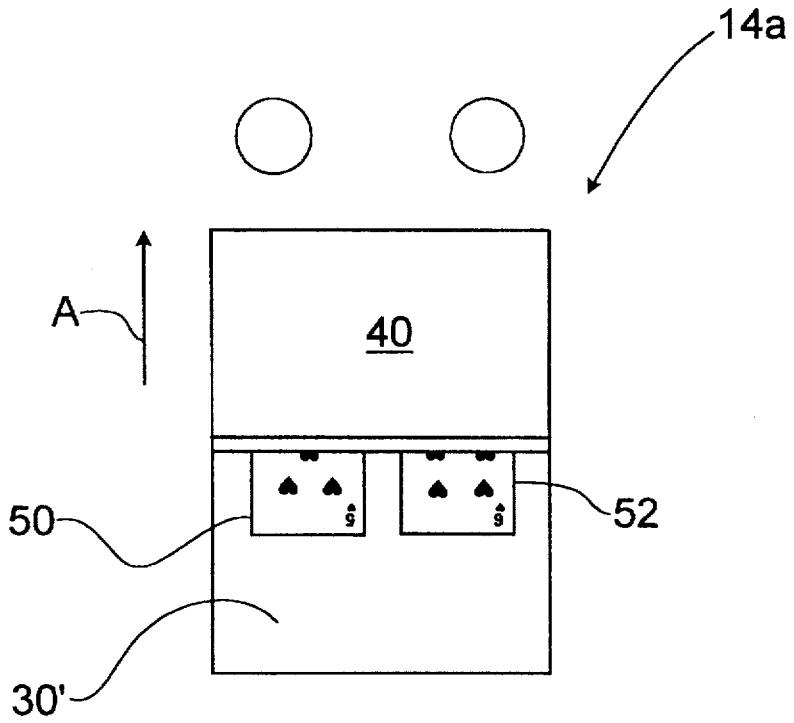
FIG. 2 illustrates a video display of a player position, showing a slidable shield for concealing the display from view.
Figure 3:
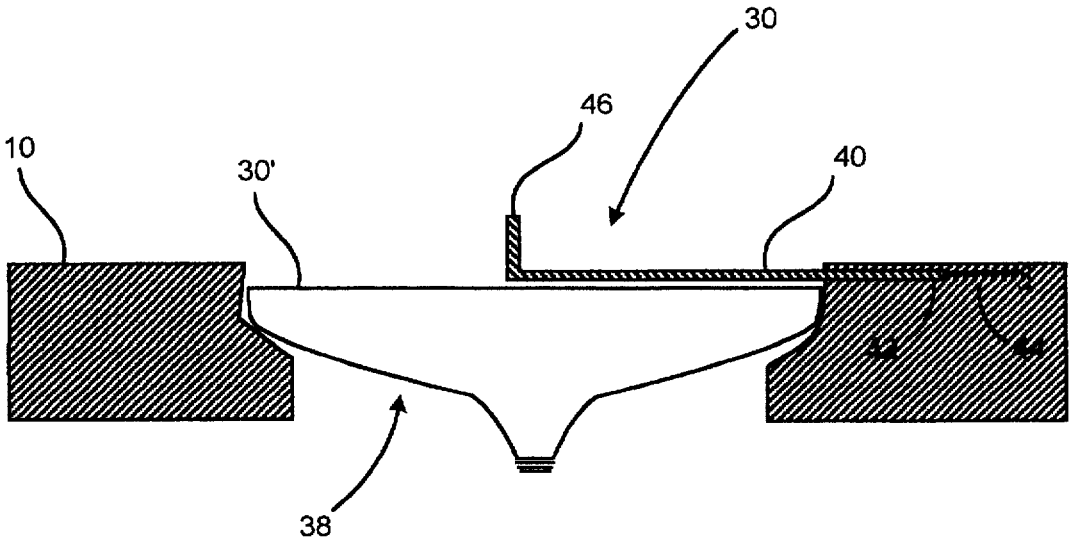
FIG. 3 is a side view of the video display of a player position, showing the slidable shield.

FIGS. 2 and 3 show, in somewhat more detail, the construction of the video display unit 30 at the player station 14*a*. Construction of the video display units 30 at the other player stations 14*b*, 14*c*, . . . , 14*i* are substantially the same. Preferably, the video display unit 30 is set in a recess 38 of the table 10 as illustrated in FIG. 3, so that the viewing surface of the display screen 30' of the video display unit 30 is nearly flush with the top surface 11 of the table 10. The display screen 30' of the video display unit 30 is covered by a slidable shield 40 when the slidable shield is in its closed position. (FIGS. 2 and 3 show the slidable shield in its half-open position.) One end 42 of the slidable shield 40 has attached a bias mechanism 44, which may be a conventional spring, that operates to urge the slidable shield to a closed position, covering the viewable surface 30' of the video display 30, and effectively shielding it from view.

The other end 46 of the slidable shield is formed as an upstanding stub (FIG. 3) so that a player may push the sliding shield 40 open in the direction indicated by the arrow A—at least enough so that the player can discern what is being displayed on the video display.

The game table 10 is constructed to implement a "cardless" card game. As will be seen, "cards" dealt a player or dealer are actually representations of cards (such as the card representations 50 and 52 shown in FIG. 2) displayed on the video display units 20 and 30. Only players signifying an intention to participate by depressing the game play button 32 will have card representations displayed on the corresponding video display 30.

Figure 4:
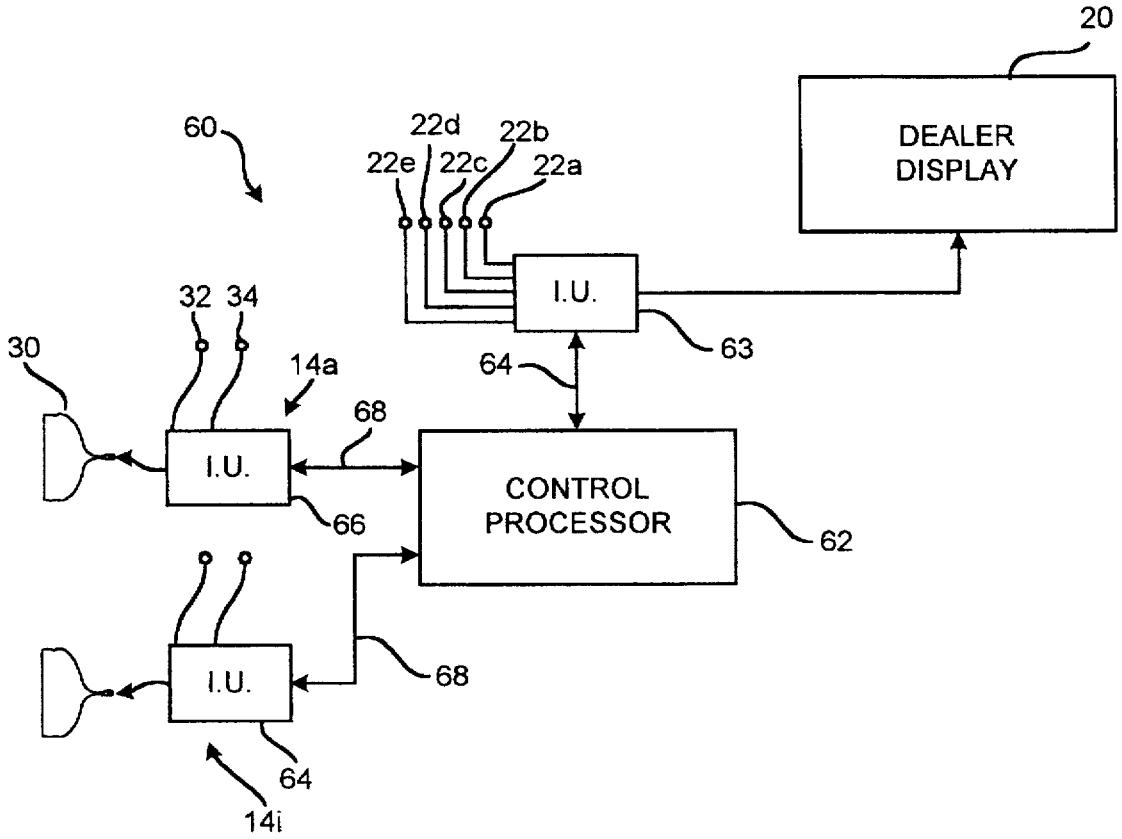
FIG. 4 is a generalized block diagram of the system used to implement the present invention.

Game play, including card representations presented on the dealer video display unit 20 and the video display units 30 of participating players, is simulated under control of a game management system 60 shown in FIG. 4. As shown, the management system 60 includes a control processor 62 that is electrically connected to a dealer interface unit 63 by signal lines 64, and to a number of player interface units (IU) 66 by corresponding sets of signal lines 68. There is a player IU 64 for each player station 14, handling signalling between the control processor 60 and the display unit 30 and finger-depressible game play buttons 32, 34.

The control processor 62 can be a conventional microprocessor, but preferably a highspeed microprocessor such as an i486 or Pentium microprocessor manufactured by Intel Corporation. (i486 and Pentium may be trademarks of Intel Corporation.) Depressing the players' and/or dealer's game play buttons (22, 32, 34) effect game play. The signals produced by depressing the game play buttons 22, 32, 34, and the order in which they are depressed, will guide operations of the control processor 60 to institute game play by causing cards representations to be displayed on the displays 20, 30. The dealer and player IUs 62, 66 operate as standard interface units to buffer signals to and from the control processor 60 and (1) the finger-depressible game play buttons 22, 32, 34, and (2) the video display units 20, 30. The IUs preferably will include sufficient buffering, memory and graphics handling circuitry for the graphics data needed to display card representations on the player and dealer video display units without requiring the control processor to continually refresh and directly control the displays.

Game play is effected by the management system 60 in response to stimuli from player and dealer stations produced by depressing various of the finger-depressible buttons at those stations. The management system 60 includes a memory (not shown) or other storage containing programming to guide the control processor to simulate a standard deck of 52 playing cards from which are dealt the cards to the participating players (i.e., those who have indicated participation by depressing game play button 32 at the particular play station), representations of which displayed on the screen 30'. The game play progresses according to stimuli from the dealer station (provided by depressing buttons 22) and, of course, the programming.

The game table is used in the following manner to implement a casino game. By way of illustration the game table 10 is discussed in terms of poker game called "Texas Hold 'Em." It will soon be evident, however, if it is not already, that the invention can be used to implement other types of card games, and not necessarily poker games.

Briefly, Texas Hold Em is a poker style game in which game play is presided over by a dealer. Participating players will match cards they receive against each other and the dealer, and the player receiving an arrangement of cards having one of a number of predetermined values greater than the card arrangements held or dealt other player and/or dealer wins. The values of card arrangements are those of conventional poker, i.e., a royal flush (a five-card arrangement consisting of a king, queen, jack, ten and nine of the same suit) is the highest, followed by a straight flush (a five-card sequence of the same suit), four of a kind, etc.

Game play begins by the dealer dealing two cards, face down, to each of the players wishing to participate. The players may view their cards, and a round (or more) of betting takes place, followed by the dealer taking three cards, face up. More betting ensues, and the dealer takes another card. Another round of betting is followed by the dealer taking one more card, followed by a final round of betting. When all betting is complete, the players remaining in the game turn up their cards. Each player combines the two cards dealt the player with any three of the five dealt the dealer. The best poker hand wins.

Figure 5:
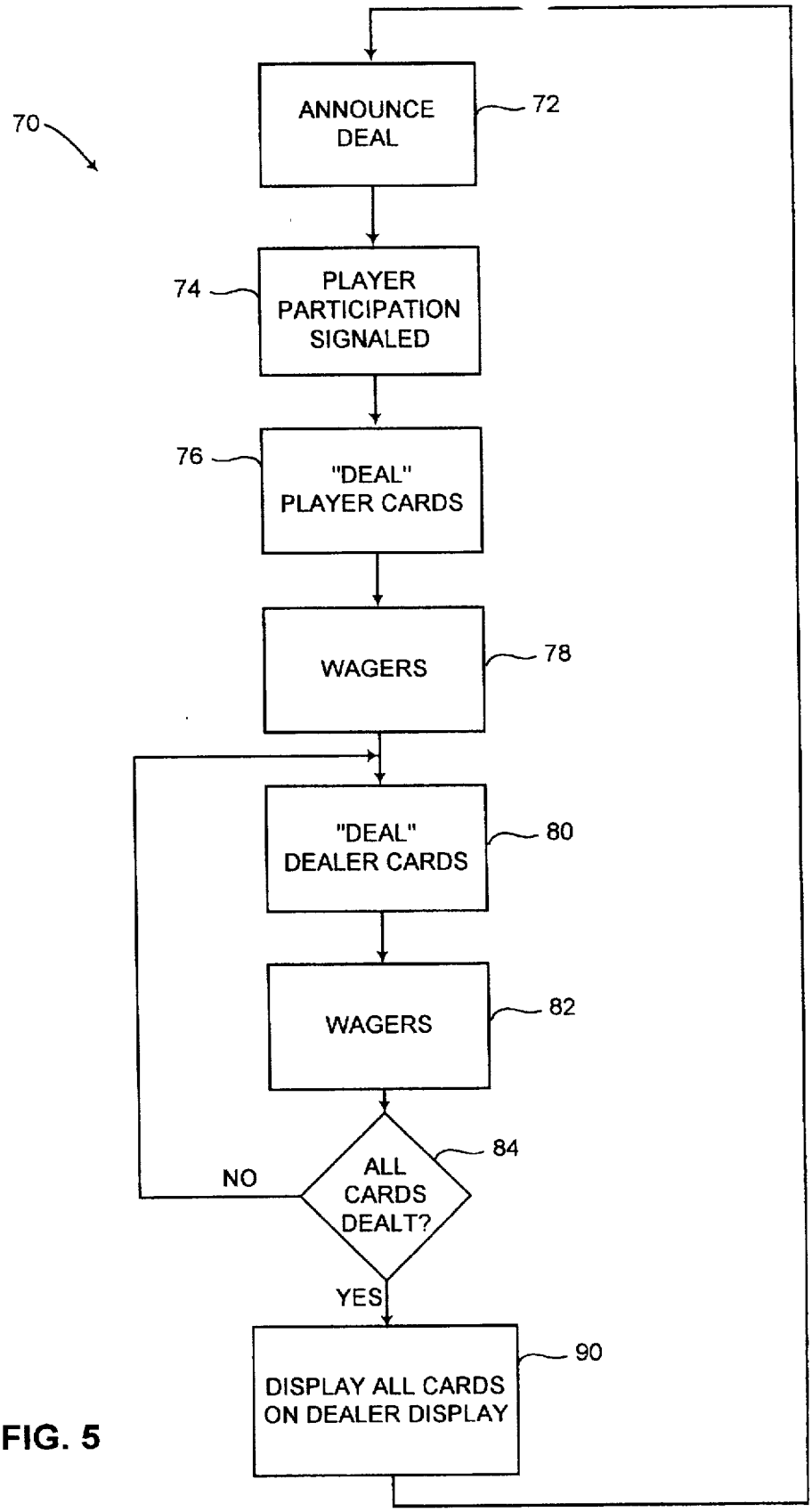
FIG. 5 is a flow chart illustrating procedure used for game play utilizing the present invention.

In the context of the present invention, the same game (Texas Hold 'Em) is conducted as follows. Referring to FIG. 5, the game play procedure 70 of using the table 10 of the present invention is generally illustrated. The game play procedure begins at step 72 with the dealer announcing a new deal. In step 74 those players wishing to participate in game play respond to the announcement by depressing the finger-depressible button 32 (FIGS. 1 and 2) at their associated player stations 14. This signals the control processor 62 (FIG. 4) as to which player positions 14 are participating in the game. Only the participating player positions will be "dealt" (provided) card representations on the screens 30' by the control processor 60.

At step 76 the dealer "deals" two cards to each player so indicating an intention to participate by button 32. This is done by the dealer depressing a "player cards" button 22*a*. This commands the control processor 60 to formulate the necessary cards and cause to be displayed on the video display unit 30 of each participating player two card representations, such as the card representations 35 and 36 in FIG. 2. Those player stations 14 not participating in game play will have blank screens.

The associated player may then "peek" at his/her cards by moving the sliding shield to uncover the display surface 30'. If desired, so as not to let others see the card representations, the player may also hold a free hand over the portion of the screen uncovered by moving the sliding shield.

After seeing what each participating dealer was dealt, a period of wagering is conducted in step 78. When all wagering has concluded, the dealer "deals" or "flops" three dealer cards (step 80) by depressing the "flop" button 22*b*. This causes the control processor to effect cards representations to be displayed on the dealer's video display unit 20 for all to see.

Play then moves on to step 82 for another round of wagers by the players. When the wagering has concluded, the dealer depresses a "deal one card" button 22*c*. The control processor checks to see if the dealer has been dealt all five cards (the three dealt in step 80, and two more by depressing the button 22*c*). If not, the procedure 70 returns to step 80 to have the control processor deal another card representation that is displayed with the earlier dealt three on the video display unit 20.

Again, wagering is conducted, followed by the dealer again depressing the "deal one card" button 22*c*. Again, the control processor, at step 84, checks to see if all five dealer cards have been dealt. If not, the procedure 70 again returns to step 80 to effect another dealer card to be represented on the dealer video display 20, and more wagers ensue.

If, during any of the game play, for example if during the wager period of step 78, a player decides to drop out of game play, he/she need only depress the game button 34 (FIGS. 1 and 2) to so signify leaving the game. Depressing button will be noticed by the control processor 60, causing it to blank the video display 30 of the "folding" player.

Continuing, after the second wager period of step 82 has concluded, the dealer may either depress once again the "deal one card" button 22*c*, or "conclusion" button 22*d*. Whichever is depressed by the dealer, the control processor will check to see how many dealer cards have been dealt. IF all five, the control processor 60 passes through step 84 to step 90, at which time representations of all player positions are displayed on the dealer video display unit 20.

Figure 6:
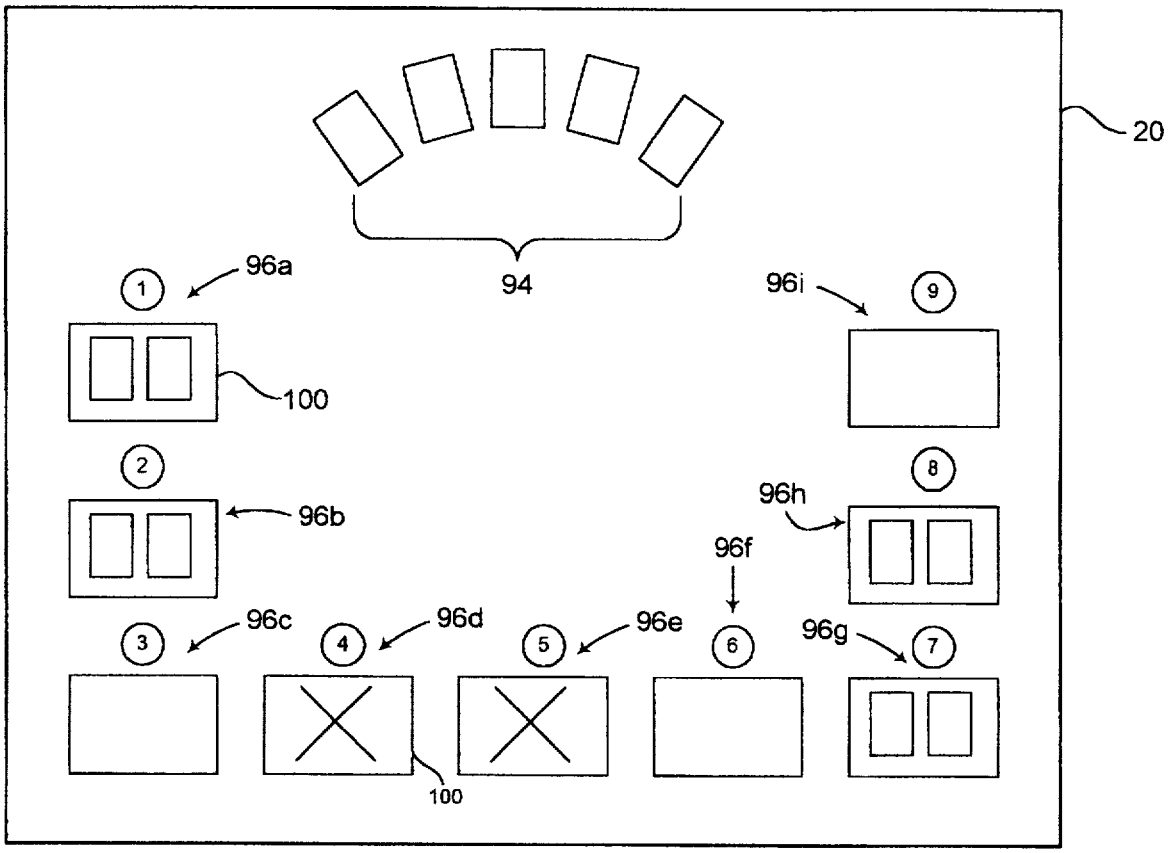
FIG. 6 is an illustrative view of the dealer's video display unit at the conclusion of game play.

A representative game conclusion display is illustrated in FIG. 6, showing the five dealer card representations displayed at display area 94. Each of the player positions 12 have corresponding player display areas 96 (96*a*, 96*b*, . . . , 96*i*) on the video display unit 20. Each player display area 96, as presented on the dealer video display screen, consists of a border 100 within which is displayed the card representations of the player at the associated player position 12. If no player participated, the interior of the border is blank. If a player participated, but dropped out during game play, that is so indicated by a large "X" inside the border 100.

The player display areas include indicia correlating the display area with the corresponding player position. Here that indicia is in the form of an encircled number 102. The encircled number will be the same as a number associated with the player position 12 (such as being imprinted on the game table 10 proximate the display 30 and/or game play buttons 32, 34). Thus, as FIG. 6 shows, the four players remained to conclude game play: those players at player positions 12 corresponding to display areas 96*a* (player position 1), 96*b* (player position 2), 96*g* (player position 7), and 96*h* (player position 8). The players at the player positions 12 corresponding to display areas 96*e* (player position 4), and 96*e* (player position 5) were participants, but dropped out sometime during game play—as indicated by the "X" inside the borders 100 for those display areas. Finally, the fact that the display areas 96*c* (player position 3), 96*f* (player position 6), and 96*i* (player position 9) are blank indicates that the corresponding player positions did not have players thereat who wished to participate.

Each player combines the two card representations provided the player with any three of the five card representations shown for the dealer, and the player with the highest poker hand wins. The game concludes with the dealer announcing the winner who takes whatever pot there may be.

The dealer then starts a new game by "reshuffling" the cards with depression of button 22*d*. The card representations disappear from the displays 20 and 30, and game play returns to step 72 of the procedure 70 with the dealer calling for an new game by announcing a deal.

Finally, should the control processor run into problems, or otherwise lock-up at such computing devices are wont to do, the dealer position also provides a reset button 22*e* that, when depressed, causes the control processor system to re-boot (from ROM, or from some other non-volatile source such as diskette, tape, etc.) to that game play starts afresh.

To summarize, there has been disclosure a game table for poker play using card representations displayed on video display screens rather than using physical cards, thereby obviating the cost of card purchases, and minimizing, if not eliminating cheating. Although the invention has been described in terms of the Texas Hold Em poker game, it should be evident to those skilled in this art that the invention may also be used to implement game play of other types of poker games such as Lo-Ball, Hi-Ball, Stud, Draw, and the like. Nor, need it be limited to poker; other card games may be implemented using the teachings of the present invention.

I claim:

1. A game table, including:

a plurality of player positions, each including a player display positioned for viewing at such player position and having means for concealing the display from viewing, and means to indicate participation in game play; and means operable at the dealer position for initiating a dealer position, having a dealer display viewable from the dealer position and the player positions and means for initiating and maintaining game play to cause representations of player cards to appear on the player display of those players indicating participation in game play, and to cause representations of dealer cards to appear on the dealer display;

the dealer position including dealer means to cause the representations of player cards to appear on the dealer display together with the representations of the dealer cards at the conclusion of game play.

2. The game table of claim 1, wherein the means for concealing includes a slidable shutter biased to cover the associated player display and conceal player card representations appearing thereon.

3. The game table of claim 2, including means for effecting movement of the slidable shutter from a closed position covering the associated player display and concealing player card representations appearing thereon to an open position permitting viewing of the player card representations appearing thereon.

4. The game table of claim 3, wherein the means for effecting movement includes a vertical upstanding tab at a terminus of the slidable shutter.

5. The game table of claim 1, wherein the means to indicate participation includes a finger depressible button.

6. The game table of claim 5, wherein the means to indicate participation further includes means illuminate to the finger depressible button to indicate activation thereof.

7. The game table of claim 1, each player position including means to indicate non-participation in game play.

8. The game table of claim 7, wherein the means to indicate non-participation in game play further includes means for withdrawing from game play.

9. The game table of claim 8, wherein the means for withdrawing from game play includes a finger-depressible button.

10. The game table of claim 9, each player station including viewable indicating means for providing an indication of the finger-depressible button.

11. The game table of claim 10, wherein the viewable indicating means include illuminating means forming a part of the finger-depressible button.

12. The game table of claim 9, each player station including viewable indicating means for providing an indication of the finger-depressible button.

13. A method of game play of a card game having a dealer and a plurality of players, including the steps:

displaying representations of cards dealt to each of the plurality of players on a plurality of player display means each associated with a corresponding one of the plurality of players, each of the player display means including means for permitting viewing substantially only by the corresponding player;

displaying representations of cards dealt to the dealer on a dealer display means that is viewable by the dealer and the plurality of players;

effecting game play for displaying the representations of cards dealt the plurality of players and the dealer; and displaying the representations of cards dealt to each of the plurality of players on the dealer display means, together with the representations of cards dealt to the dealer, at the conclusion of game play.

14. A game table, including:

a dealer position, having a dealer display viewable from the dealer position;

a plurality of player positions, each including a player display positioned for viewing at such player position and having means for concealing the display from viewing, and means to indicate participation in game play; and means operable at the dealer position for initiating game play to cause representations of player cards to appear on the player display of those players indicating participation in game play, and to cause representations of dealer cards to appear on the dealer display;

wherein the means for concealing includes a slidable shutter biased to cover the associated player display and conceal player card representations appearing thereon.

15. The game table of claim 14, wherein the means to indicate participation includes a finger depressible button.

16. The game table of claim 15, wherein the means to indicate participation further includes means illuminate to the finger depressible button to indicate activation thereof.

17. The game table of claim 14, wherein the dealer position includes dealer means to cause the representations of player cards to appear on the dealer display together with the representations of the dealer cards at the conclusion of game play.

18. The game table of claim 14, including means for effecting movement of the slidable shutter from a closed position covering the associated player display and concealing player card representations appearing thereon to an open position permitting viewing of the player card representations appearing thereon.

19. The game table of claim 14, each player position including means to indicate non-participation in game play.

20. The game table of claim 19, wherein the means to indicate non-participation in game play further includes means for withdrawing from game play.

21. The game table of claim 20, wherein the means for withdrawing from game play includes a finger-depressible button.

* * * * *